United States Patent [19]

Belttary

[11] 4,231,006

[45] Oct. 28, 1980

[54] CIRCUIT BREAKER HAVING A THERMALLY RESPONSIVE LATCHING MEMBER

[75] Inventor: Harold E. Belttary, Rio Piedras, P.R.

[73] Assignee: Sylvania Circuit Breaker Corporation, Canovanas, P.R.

[21] Appl. No.: 23,800

[22] Filed: Mar. 26, 1979

[51] Int. Cl.[3] ..... H01H 73/48

[52] U.S. Cl. ..... 335/36; 335/37; 335/43; 337/75

[58] Field of Search ..... 335/36, 172, 173, 35, 335/37, 23, 43, 45; 337/75, 82, 94

[56] References Cited

U.S. PATENT DOCUMENTS

| | | | |
|---|---|---|---|
| 3,671,908 | 6/1972 | Belttary et al. | 337/54 |
| 3,909,764 | 9/1975 | Belttary | 337/75 |

*Primary Examiner*—Harold Broome
*Attorney, Agent, or Firm*—Fred Fisher

[57] ABSTRACT

A circuit breaker is provided with a thermally responsive latching member connected in circuit between a load terminal and a movable contact. A mounting member, holding a portion of the latching member adjacent one end thereof, is pivotally mounted in the circuit breaker housing. A U-shaped field piece is affixed to the mounting member with legs of the piece extending at both sides and toward the latching member, and toward an armature spaced on the opposite side of the latching member. The armature has its associated armature spring provided with an annular boss which is adapted to fit within a locating hole in the latching member. The field piece is adapted to intercept lines of flux of a magnetic field created by a predetermined amount of current flowing through the latching member to attract the armature to rotate the latching member thereby disengaging a latching surface of the latching member from a trip arm, releasing the trip arm for movement to a tripped position. A mounting spring bears against the housing and urges the field piece against a support member, and further urges the armature spring against the latching member and positions the boss into the locating hole.

4 Claims, 4 Drawing Figures

CIRCUIT BREAKER HAVING A THERMALLY RESPONSIVE LATCHING MEMBER

BACKGROUND OF THE INVENTION

This invention relates to circuit breakers. More particularly, it is concerned with low voltage circuit breakers for controlling low and moderate power electrical circuits. Thus, it is an object of this invention to provide new and improved circuit breakers of such character.

A circuit breaker for use in controlling electrical circuits typically has a set of contacts, one fixed and one moving, and a toggle, or overcenter mechanism, which is manually operated to close and open the contacts. A circuit breaker also includes an overload mechanism for tripping the circuit breaker and opening the contacts when the electrical current through the circuit breaker exceeds certain predetermined conditions. The overload mechanism may include a thermally responsive member such as a thermostat element which functions to trip the breaker when an overload current exists. The circuit breaker may also include a magnet and armature arrangement for tripping the breaker rapidly in response to certain predetermined conditions.

A variety of circuit breakers of the general form described above are well-known and widely used. One particularly useful type of circuit breaker employed in protecting low voltage low and moderate power circuits is described and claimed in U.S. Pat. No. 3,671,908 issued on June 20, 1972 to Harold E. Belttary and John G. Palmer entitled "Circuit Breaker". Circuit breakers as described in the aforementioned patent are completely satisfactory for use in their intended applications. However, for certain applications it is desirable to provide a circuit breaker in which the number and complexity of parts are reduced, thereby also reducing the costs of fabrication and assembly. A circuit breaker of simplified construction is described and claimed in U.S. Pat. No. 3,904,998 issued Sept. 9, 1975 to Harold E. Belttary entitled "Circuit Breaker".

In certain applications, it is desirable to employ two or more circuit breakers in combination so that when any one is tripped in response to an overload condition the others will be tripped also. Typically, the circuit breakers are mounted in side-by-side relation with an interconnection between the tripping mechanisms. Circuit breakers as described in the foregoing patent employ a simplified triggering arrangement and are not readily adapted for interconnection so as to cause mutual tripping.

In other applications, it is desirable to provide the magnet and armature arrangement for rapidly tripping a breaker to an existing mechanism which does not provide magnetic sensing, such as, for example, the mechanism disclosed in U.S. Pat. No. 3,909,764 issued on Sept. 30, 1975 to Harold E. Belttary entitled "Electric Circuit Breaker". Thus, it is another object of this invention to provide new and improved arrangements of such character.

Many inexpensive magnetic systems employed in circuit breakers are not independent of thermal calibration in that thermal calibration may change the gap between armature and pole faces or may have an effect on latch loading. Hence, it is an object of this invention to provide for new and improved circuit breakers in which the sensitivity of the "Magnetic Trip Level" is independent of "Thermal Calibration" settings.

SUMMARY OF THE INVENTION

A circuit breaker in accordance with the present invention is of relatively simple construction and may include means for permitting adjacent breakers to be interconnected so as to cause mutual tripping. The circuit breaker includes a housing of insulating material with a fixed contact and a movable handle mounted in the housing. A contact carrier on which a movable contact is mounted pivotally engages the handle at a pivot point. The circuit breaker also includes a trip arm which is pivotally mounted in the housing. An overcenter spring is connected between the contact carrier and the trip arm so as to urge the contact carrier against the handle. The handle, contact carrier, and overcenter spring form an overcenter arrangement, or toggle, which act to close the contacts when the spring is on one side of the pivot point and to open the contacts when the spring is on the other side of the pivot point. A load terminal is also mounted in the housing.

A thermally responsive latching member is connected in circuit between the load terminal and the movable contact. A portion of the thermally responsive latching member adjacent to one end is held in a mounting member which is pivotally mounted in the housing at a pivotal connection. A support member is mounted in the housing and bears against the field piece.

A mounting spring urges the field piece against the support member. The mounting spring further urges a spring of an armature against the thermal responsive latching member and positions same by means of an annular boss formed on the armature spring into a hole in the thermal responsive latching member. The pivotal connection, the support member, the field piece, and the mounting member, in combination, hold the portion of the thermally responsive latching member adjacent the one end in fixed position with respect to the housing with the thermally responsive latching member being rotatable about the pivotal connection against the urging of the mounting spring. The thermally responsive latching member has a latching surface adjacent its opposite end which engages the trip arm when the contacts are closed and maintains the trip arm in a set position with the overcenter spring urging the trip arm toward a tripped position. In response to a predetermined current condition, the thermally responsive latching member bends, causing its opposite end to move with respect to its one end, thereby disengaging the latching surface from the trip arm and releasing the trip arm for movement to the tripped position. A U-shaped field piece is fastened to the mounting member with the legs of the piece extending at both sides and toward the latching mechanism and facing the armature. When a relatively high predetermined current flows through the thermally responsive latching member, magnetic lines of flux intercepted by the field piece are so significant as to attract the armature. The latching member thus rotates within the mounting member, releasing the trip arm for movement to the tripped position.

When the trip arm moves to the tripped position, the overcenter spring is moved to the other side of the pivot point causing the contacts to open.

BRIEF DESCRIPTION OF THE DRAWINGS

Additional objects, features, and advantages of circuit breakers in accordance with the present invention will be apparent from the following detailed discussion together with the accompanying drawings wherein.

DETAILED DESCRIPTION OF THE INVENTION

Figure 1:
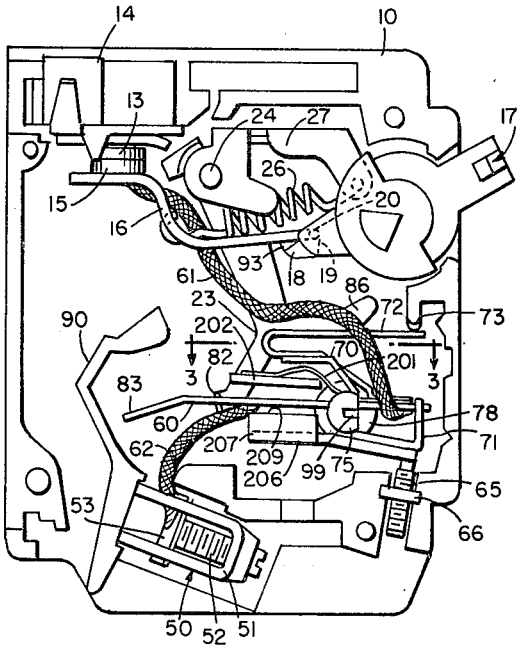
FIG. 1 is a side elevational view of a circuit breaker in accordance with the invention with the cover of the housing removed and with the contacts in the closed position.

A circuit breaker in accordance with the present invention as illustrated in the figures includes a housing comprising a case 10 of a suitable insulating material and a cover 11 of similar material. The case and cover are typically of molded plastic. The various elements of the circuit breaker mechanism are mounted within the case 10 and held in place by the cover 11 which is riveted to the case.

A fixed contact 13 is mounted on a clip 14 which is designed to engage a line bus when the breaker is inserted into a distribution panel box. A moving contact 15 is mounted on a contact carrier 16. A handle 17 of insulating material is pivotally mounted within the case 10 in a conventional manner for manual operation.

Figure 2:
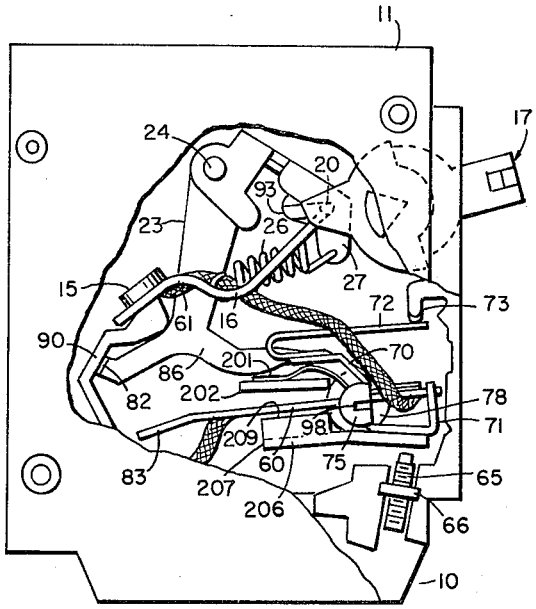
FIG. 2 is a view of the circuit breaker similar to the view of FIG. 1 with the cover in place but with portions broken away to show the elements in the tripped position.

The end of the contact carrier 16 is positioned in slots 18 and 19 in two arms extending from the handle 17 so as to provide a pivot point of connection 20 between the contact carrier 16 and the handle 17. A trip arm 23 is mounted on a boss 24 in the case 10 for pivoting between the set position as shown in FIG. 1 and the tripped position as shown in FIG. 2. An overcenter tension spring 26 has one end connected to the contact carrier 16 and the other end connected to an arm 27 of the trip arm 23. The handle 17, contact carrier 16, and the spring 26 form an overcenter arrangement, or toggle, which urges the movable contact 15 toward the fixed contact 13 when the spring 26 is on one side of the pivot point 20 as shown in FIG. 1 and urges the movable contact 15 to the open position, when the spring 26 is on the other side of the pivot point 20.

A load terminal 50 for connecting the circuit breaker to a load circuit is also positioned in molded case 10. The terminal includes a lug 51, a load bar 53, and a screw 52 for clamping a wire against the load bar 53.

Figure 3:
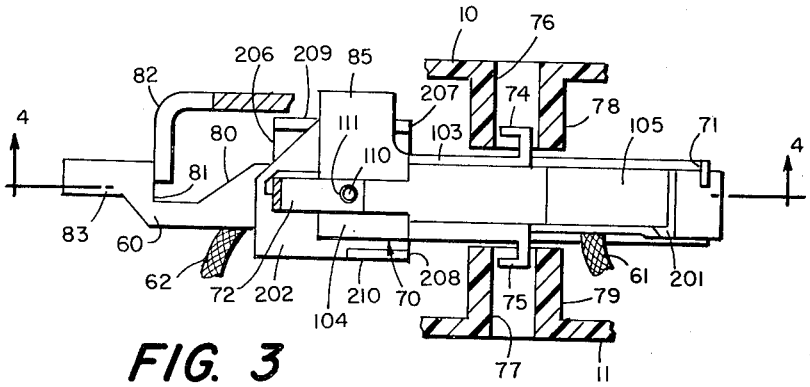
FIG. 3 is a detailed view taken along the line 3—3 of FIG. 1.

A thermally responsive latching member 60 is electrically connected between the movable contact 15 and the load terminal 50 by flexible conductors 61 and 62 of stranded wire, typically copper. The thermally responsive latching member 60 as best seen in FIG. 3 is a unitary structure consisting of a generally flat elongated thermostat element. The thermostat element includes at least two layers of metal having different coefficients of thermal expansion, so that the element bends as its temperature is increased. One end of the flexible conductor 61 is attached directly to the thermostat element adjacent to one end, and the other end of the flexible conductor 61 is attached to the contact arm 16 at its point of attachment to the movable contact 15. One end of the flexible conductor 62 is connected directly to the thermostat element 60 closely adjacent to a notch 80 (see FIG. 3) in the opposite end of the thermostat element. The other end of the flexible conductor 62 is attached to the load bar 53 of the load terminal 50.

Figure 4:
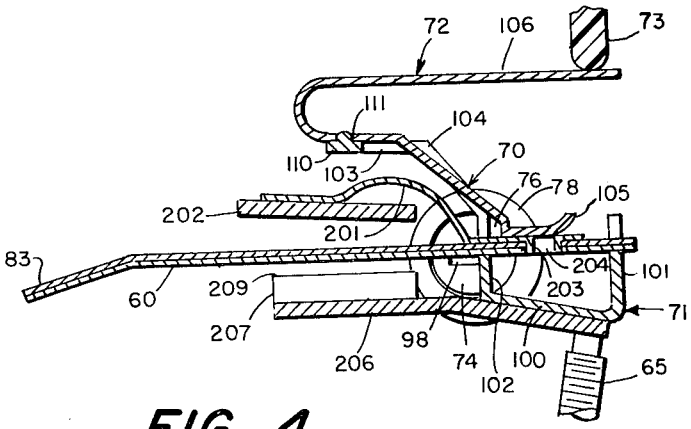
FIG. 4 is a detailed view taken generally along the line 4—4 of FIG. 3.

As best seen in FIGS. 3 and 4, the thermostat element 60 is held by one end portion in a mounting member 70 consisting of a lever 71 and a spring 72. The lever 71 is a single stamping of thin metal having a section 100 lying generally parallel to the thermostat element 60. The section 100 is a few degrees from being precisely parallel with the thermostat element for reasons which will be explained hereinbelow. Two adjoining sections 101 and 102 lie normal to the thermostat element. The thermostat element 60 contacts the upper edge surface of the section 101 and also an edge surface in the section 102 provided by an opening. Another section 103 of the lever 71 extends upward from the section 102 at an angle and another section 104 lying parallel to section 100 adjoins section 103. Sections 103 and 104 have an opening and portions of the spring 72 fit into the opening. A boss 110 in section 104 engages an opening 111 in the spring 72. A spring 201 is coupled to an armature 202. An arm 105 of the spring 72 bears downward against the armature spring 201 against the thermostat element 60 in the region between the edges of the two sections 101 and 102, thereby holding the thermostat element 60 in the mounting member 70. The armature spring 201 has an annular boss 203 formed therewithin which seats within a hole 204 in the thermostat element 60, thereby positioning same.

A pair of trunnions 74 and 75 extend from opposite sides of the section 102 of the mounting member 70. The trunnions 74 and 75 fit in aligned axial openings 76 and 77 in bosses 78 and 79 in the case 10 and cover 11, respectively. An upper arm 106 of the spring 72 bears against an upstanding rib 73 in the case 10 and serves to urge rotation of the mounting member and thermostat element in a clockwise direction about the axis of the trunnions 74 and 75 in addition to seating the boss 203 of the armature spring 201 within the thermostat element 60. The mounting member 70 also has an arm 85 extending from section 104 which intercepts an arm 86 of the trip arm 23 as the trip arm rotates from the set position to the tripped position as will be explained hereinbelow.

A support member includes a threaded rod or screw 65 which is threaded in a nut 66 and lies generally normal to the thermostat element 60. The nut 66 is mounted in the case 10 so as to prevent its rotation. The spring 72 urges the mounting member 70 in a clockwise direction causing a portion of a U-shaped field piece 206, which is fastened (as by welding) to the section 100 of the mounting member, to bear against the threaded rod 65. The U-shaped field piece 206 is fastened with the legs 207-208 facing the armature 202. Since the threaded rod 65 is a few degrees away from being precisely normal to the thermostat element, the section 100 of the lever 71 is out of parallel with the thermostat element by approximately the same amount. Therefore, at their point of contact, the threaded rod 65 and the portion of the field piece 206 are almost exactly normal. Rotation of the rod to advance or retract it together with the action of the spring 72 causes the thermostat element 60 to pivot about the axis of the trunnions 74 and 75. This action changes the position of the opposite end of the thermostat element and thus the breaker is adjusted for tripping at a different predetermined current value as will be explained hereinbelow.

The notch 80 in the thermostat element 60 is adjacent its opposite end and provides a latching surface 81 against which a flange 82 of the trip arm 23 bears. The trip arm 23 tends to pivot about the boss 24 by virtue of the urging of the overcenter spring 26. The trip arm is maintained in its set position as shown in FIG. 1 by the flange 82 abutting the latch surface 81 and preventing further movement.

The thermostat element 60 has an extension 83 which is angled downward. This extension serves as a ramp to deflect the end of the thermostat element 60 downward thus allowing the flange 82 of the trip arm to slide along the extension 83 and enter the notch 80 and reengage the latching surface 81 when the trip arm 23 is being reset from the tripped to the set position. The effective length of the thermostat element lies between the end portion which is clamped against section 101 of the lever 71 and the region of the notch 80. Current flows through the thermostat element between the flexible conductors 61 and 62 which are directly connected to the thermostat element adjacent to its ends.

The passage of a significant quantity of current through the thermostat element 60 sets up a magnetic field. The lines of flux of the magnetic field are intercepted or gathered by the field piece 206 and concentrated by the field piece at its pole faces 209-210, thus attracting the armature 202 thereagainst when the current exceeds a predetermined value. The armature 202, when attracted by the field piece 206, and supported by the armature spring 201, causes the thermostat element 60 to rotate within the mounting member (i.e., not bend). The rotation of the thermostat element 60 releases the trip arm 23 for movement to the tripped position.

An upstanding member 90 in the case provides a wall defining the lower portion of the arc chute and also provides a stop to limit movement of the contact carrier 16 when the contacts are opened. The upstanding member 90 also serves as a stop for limiting movement of the trip arm 23 and the contact carrier 16 in the tripped position as illustrated in FIG. 2.

The circuit breaker operates in the customary manner for closing and opening the contacts. The contacts are closed by rotating the handle 17 upward to the fully counterclockwise position as shown in FIG. 1. The contacts are opened manually by rotating the handle 17 in a clockwise direction to the fullest possible downward position. This action moves the pivot point 20 of the contact carrier 16 and the handle 17 in a clockwise direction to the opposite side of the overcenter spring 26. With the pivot point 20 on the opposite side of the overcenter spring 26, the force of the spring 26 completes the opening action, moving the contact carrier 16 to the open position with the carrier against the stop member 90.

The closed contacts are opened automatically by the overload mechanism under conditions of predetermined current flow. With the contacts closed, the electrical current flowing through the thermostat element produces heating and causes the end of the element containing the latching surface 81 to bend away from the flange 82 of the trip arm with the increasing temperature. The amount of heating and therefore the amount of movement of the end of the thermostat element is a function of the magnitude of the current flowing through the element 60. If the current flow is sufficient to produce enough heat, the thermostat element bends sufficiently so that the latch surface 81 clears the flange 82 of the trip arm 23 releasing the trip arm. The overcenter spring 26 acting on the arm 27 causes the trip arm 23 to rotate about the boss 24 in a clockwise direction. The trip arm 23 moves to the tripped position abutting the upstanding member 90 as shown in FIG. 2.

As stated hereinabove, the passage of a predetermined level of current, usually higher than that required for thermal release, causes the circuit breaker to be magnetically tripped or released, thereby opening the circuit.

As the trip arm 23 rotates in a clockwise direction, the end of the spring 26 carried by the arm 27 also moves in a clockwise direction and carries the spring 26 to the other side of the pivot point 20. With the center line of the spring 26 on the opposite side of the pivot point 20, the spring rapidly forces the contact carrier 16 to the tripped position against the member 90 as shown in FIG. 2 separating the contacts 13 and 15. The handle 17 assumes an intermediate position as shown in FIG. 2.

Also as the trip arm 23 rotates to the tripped position, the edge of the arm 86 of the trip arm engages the arm 85 of the mounting member 70. The mounting member 70 and thermostat element are rotated counterclockwise against the bias of the spring 72 and held in the position shown in FIG. 2.

The tripped circuit breaker is manually reset by rotating the handle 17 to the manual open or extreme clockwise position. During this movement an arm 93 on the handle 17 engages an area of the trip arm 23, rotating the trip arm in the counterclockwise direction about the boss 24. As the trip arm 23 rotates, the spring 72 causes the lever 71, armature 202, field piece 206, and thermostat element 60 to rotate toward the normal position as shown in FIG. 1. At some point during the rotation of the trip arm, the flange 82 contacts the ramp portion 83 of the thermostat element 60 and slides along the ramp portion deflecting the end of the element downward. When the flange 82 reaches the notch 80, the arm 86 of the trip arm no longer contacts the arm 85 of the mounting member 70 and the end of the thermostat element 60 moves into position so that the latch surface 81 intercepts the flange 82, resetting the breaker. During the resetting operation, the contact carrier 16 is also restored to the position it assumes when the contacts are opened manually. The contacts may then be closed by rotating the handle 17 in the counterclockwise direction to restore the circuit breaker to the latched condition shown in FIG. 1.

The circuit breaker is adjusted to cause tripping at a specific value of current by rotating the threaded rod 65 so as to advance it or retract it. As the rod is advanced, it tilts the mounting member 70 and thermostat element 60 counterclockwise further compressing the spring 72. The latching surface 81 of the thermostat element 60 is thus moved downward with respect to the flange 82 of the trip arm 23 so that a lesser amount of current is sufficient to trip the circuit breaker. Retraction of the threaded rod 65 raises the latching surface 81 so that a greater amount of current is required to cause bending of the thermostat element to the point of releasing the trip arm 23.

The circuit breaker is adjusted to cause magnetic tripping at specific values of current by adjusting the gap between the armature 202 and the pole faces 209-210. This achieved by the selection of an appropriately formed armature spring 201.

Two or more circuit breakers in accordance with the foregoing description can operate as described in U.S. Pat. No. 3,909,764 issued on Sept. 30, 1975 to Harold E. Belttary entitled "Electrical Circuit Breaker", or they can operate as a single pole breaker.

Circuit breakers in accordance with the foregoing description employ few parts and are relatively simple in construction. Much of the supporting structure is built into the housing which is fabricated of two molded plastic parts, the case 10 and cover 11. The overload triggering mechanism is relatively simple including only the unitary structure of the thermostat element 60 itself, together with the mounting member 70 (including spring 72), an armature 202 (including spring 201), a field piece 206, and the threaded rod 65. An advantage of this construction, in addition to its simplicity and ease of fabrication and assembly, is that heat dissipation from the thermostat element 60 is at a minimum. No large heat conducting elements contact the thermostat element, nor is its position affected by virture of having mounting members attached thereto. Flexible conductors 61 and 62 are employed rather than relatively massive rigid members. Furthermore, a separate calibration or adjusting mechanism is not required. The threaded rod 65 together with the nut 66 mounted in the case serves both as an element of the supporting structure for the thermostat element and as the thermal overload current adjusting screw.

While there has been shown and described what is considered a preferred embodiment of the present invention, it will be obvious to those skilled in the art that various changes and modifications may be made therein without departing from the invention as defined in the appended claims.

What is claimed is:

1. A circuit breaker including in combination a housing of insulating material;

a fixed contact mounted in said housing;

a movable handle mounted in said housing;

a contact carrier with a movable contact thereon and pivotally engaging said handle at a pivot point;

a trip arm pivotally mounted in said housing;

an overcenter spring connected between said contact carrier and said trip arm urging said contact carrier against said handle;

said handle, contact carrier, and overcenter spring forming an overcenter arrangement for closing said contacts when the spring is on one side of said pivot point and for opening said contacts when the spring is on the other side of said pivot point;

a load terminal mounted in said housing;

a thermally responsive latching member connected in circuit between said load terminal and said movable contact, said latching member having a locating hole therewithin;

an armature;

an armature spring affixed to said armature and having a free end provided with an annular boss adapted to fit within said locating hole;

a mounting member holding the thermally responsive latching member at a portion thereof adjacent to one end;

said mounting member being pivotally mounted in said housing at a pivotal connection;

a U-shaped field piece affixed to said mounting member with legs of said piece extending at both sides and toward said thermally responsive latching member and facing said armature;

a support member mounted in said housing and bearing against said field piece; and a mounting spring bearing against the housing and urging said field piece against said support member whereby said pivotal connection, said support member, said field piece, and said mounting member in combination hold the portion of the thermally responsive latching member adjacent said one end fixed with respect to the housing, said thermally responsive latching mechanism being rotatable about the pivotal connection against the urging of said mounting spring;

said thermally responsive latching member having a latching surface adjacent the opposite end thereof engaging said trip arm and maintaining said trip arm in a set position when said contacts are closed, with said overcenter spring urging said trip arm toward a tripped position;

said thermally responsive latching member bending in response to a predetermined current condition to move said opposite end of the thermally responsive latching member and disengage said latching surface from said trip arm releasing said trip arm for movement to the tripped position;

said U-shaped field piece being adapted to intercept lines of flux of a magnetic field created by a predetermined amount of current flowing through said thermally responsive latching member to attract said armature against said latching member to rotate said latching member thereby disengaging said latching surface from said trip arm, releasing said trip arm for movement to said tripped position; and movement of the trip arm to the tripped position moving the overcenter spring to the other side of said pivot point causing said contacts to open.

2. The circuit breaker as recited in claim 1 wherein said mounting spring further urges said armature spring against said latching member, and positions said annular boss into said locating hole.

3. The circuit breaker as recited in claim 2 wherein said boss of said armature spring seats within said locating hole.

4. A circuit breaker in accordance with claim 3 wherein said thermally responsive latching member is a unitary structure consisting of a generally flat elongated thermostat element.

* * * * *